United States Patent [19]

Herrnring

[11] 4,168,129

[45] Sep. 18, 1979

[54] PERMANENT-MAGNETICALLY HELD CLOSURE CAP FOR WRITING INSTRUMENTS

[75] Inventor: Günther Herrnring, Alvesloe, Fed. Rep. of Germany

[73] Assignee: Montblanc-Simplo GmbH, Hamburg, Fed. Rep. of Germany

[21] Appl. No.: 770,829

[22] Filed: Feb. 22, 1977

[30] Foreign Application Priority Data

Feb. 19, 1976 [DE] Fed. Rep. of Germany ..... 2606550

[51] Int. Cl.[2] ..... B43K 9/00

[52] U.S. Cl. ..... 401/243; 401/213; 220/230; 292/251.5; 335/306

[58] Field of Search ..... 401/243, 244, 202, 100, 401/245, 246, 247, 62, 124, 213, 262; 206/818; 220/230; 24/73 MS, 201 B; 211/69.1; 292/251.5; 335/296, 297, 302, 303, 306

[56] References Cited

U.S. PATENT DOCUMENTS

| | | | |
|---|---|---|---|
| 2,438,231 | 3/1948 | Schultz et al. | 401/244 |
| 2,949,569 | 8/1960 | Pierce et al. | 335/302 |
| 3,009,225 | 11/1961 | Budreck | 24/201 B |
| 3,093,113 | 6/1963 | Reynoso | 401/243 X |
| 3,141,214 | 7/1964 | Bey | 24/201 B |
| 3,400,349 | 9/1968 | Harra | 335/306 X |

*Primary Examiner*—Clifford D. Crowder
*Attorney, Agent, or Firm*—Becker & Becker, Inc.

[57] ABSTRACT

A closure cap which is held on writing instruments by a permanent magnet connected to the cap. The permanent magnet is arranged near the closed end of the cap, has a nearly cylindrical cross section, and has pole shoes on its pole faces, the free ends of the pole faces engaging ferro-magnetic annular parts of the writing instrument when the cap is placed on the latter.

10 Claims, 6 Drawing Figures

FIG.3
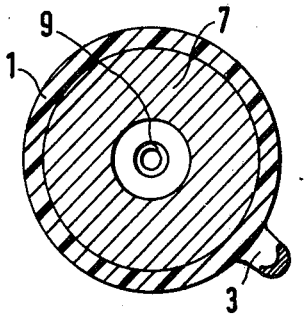
FIG.4
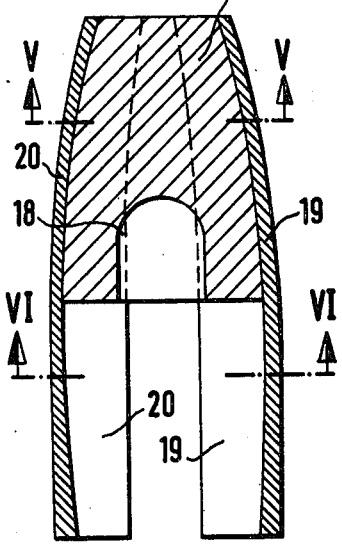
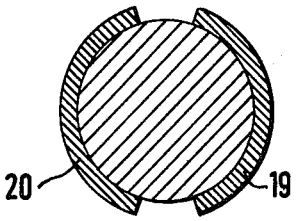
FIG.5
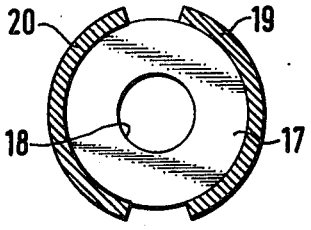
FIG.6

PERMANENT-MAGNETICALLY HELD CLOSURE CAP FOR WRITING INSTRUMENTS

The present invention relates to a permanent-magnetically held closure cap for writing instruments.

Already for decades, industry has endeavored to develop closure caps held magnetically on writing instruments. Until now, however, these endeavors have failed, above all, because in customary caps for writing instruments the space available for permanent magnets is very small and because, as a result of great magnetic resistance, only a small proportion of the magnetic flux could be fully utilized for the holding force.

It is an object of the present invention to overcome the above mentioned difficulties and to produce a magnetically held closure cap which, in spite of the small installation space available for the permanent magnet, develops very great magnetic holding forces.

These and other objects and advantages of the present invention will appear more clearly from the following specification in connection with the accompanying drawings in which:

FIG. 3 is a cross section along the section line III—III of FIG. 1.

FIG. 4 is an axial section of the magnetic system arranged in the cap of FIG. 2.

FIG. 5 is a cross section along the section line V—V of FIG. 4 and

FIG. 6 is a cross section along the section line VI—VI of FIG. 4.

Figure 1:
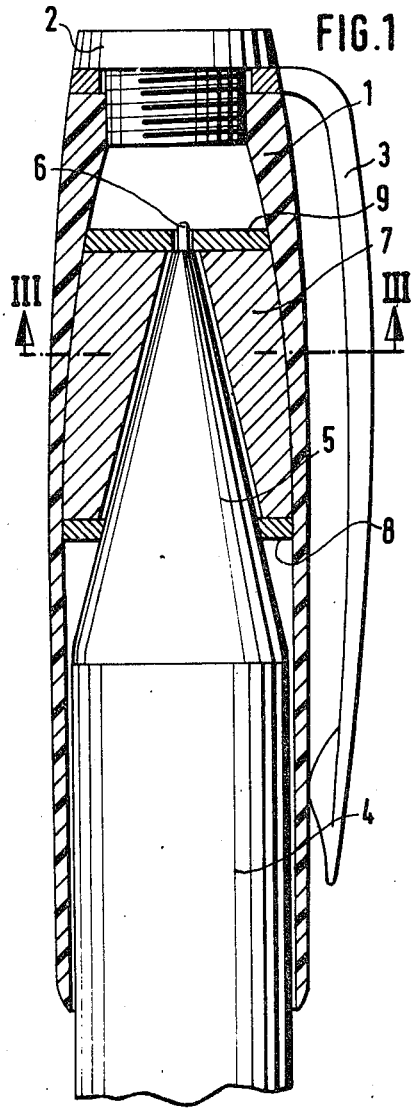
FIG. 1 is an axial section through the upper end of a ball point pen having a permanent-magnetically held closure cap according to the present invention placed on the pen.

The closure cap of the present invention is characterized primarily in that the permanent magnet is arranged near the closed end of the cap, has a cross section having an essentially circular outer contour, and has pole shoes on its pole faces, the free ends of the pole faces engaging ferro-magnetic annular parts of the writing instrument when the cap is placed on the latter. The permanent magnet, with its pole shoes, is connected to the cap in any convenient manner, for instance by bonding.

The permanent magnet may be magnetized either in or perpendicular to the longitudinal direction of the cap. If magnetized in the longitudinal direction, the permanent magnet has an axial bore shaped to correspond to the shape of the tip or head of the writing instrument and is provided with annular plates or discs which represent the pole shoes and are radial to the axial bore. If magnetized perpendicular to the longitudinal direction of the cap, the permanent magnets are provided with cup or shell-like pole shoes which cooperate with the permanent magnets at their poles and which project toward the opening of the cap where, on the writing instrument, an annular part is provided which engages the pole shoes in the axial direction.

The permanent-magnetically held closure cap of the present invention may be used for any writing instrument, be it fountain pen, capillary tube pen with liquid ink, ball point pen, or fiber or felt tip pen.

Referring now to the drawing in detail, only a ball point pen and a fountain pen are shown as examples of such writing instruments.

The ball point pen 4 shown in FIG. 1 has on its conical front end 5 a writing point or tip 6 which is a part of a ball point pen refill or filler which is not shown further. The conical front end 5 of the ball point pen 4 is comprised of ferro-magnetic metal or is plated or coated with such a metal.

The closure cap 1 provided for this ball point pen 4 is closed in a manner known per se, at the back, with a threaded plug or stopper 2 which also serves for mounting a clip 3. In the region of the closed end of the cap is an essentially cylindrical or—corresponding to the shape of the cap—slightly conical permanent magnet 7, which has an axially directed conical bore, the conical angle of which is adapted to the taper of the front end 5 of the ball point pen 4. This permanent magnet 7 is magnetized in the longitudinal direction so that a north pole is at its upper end and a south pole is at its lower end, or vice versa. The poles of the permanent magnet 7 are covered with annular pole shoes 8,9. The pole shoe 9 provided at the inner end of the cap 1 covers the entire adjacent end face of the magnet 7 and extends slightly beyond the axial bore of the magnet 7, so that the end face of the front end 5 of the ball point pen 4, at the writing point 6 proper, may engage the pole shoe 9 in the axial direction. The pole shoe 8 provided at the open end of the cap 1 likewise covers the adjacent pole surface of the magnet 7 and is beveled so as to be flush with the conical bore of the magnet 7 so that the pole shoe 8 can cooperate with the front end 5 of the ball point pen 4 over the entire circumference of the front end 5. Experience has shown that such a cap design can achieve a holding force of far more than 100 grams. As shown in the drawing, the magnetic circuit between the two pole shoes 8 and 9 is closed by means of the ferro-magnetic material on the front end 5 of the ball point pen 4.

Figure 2:
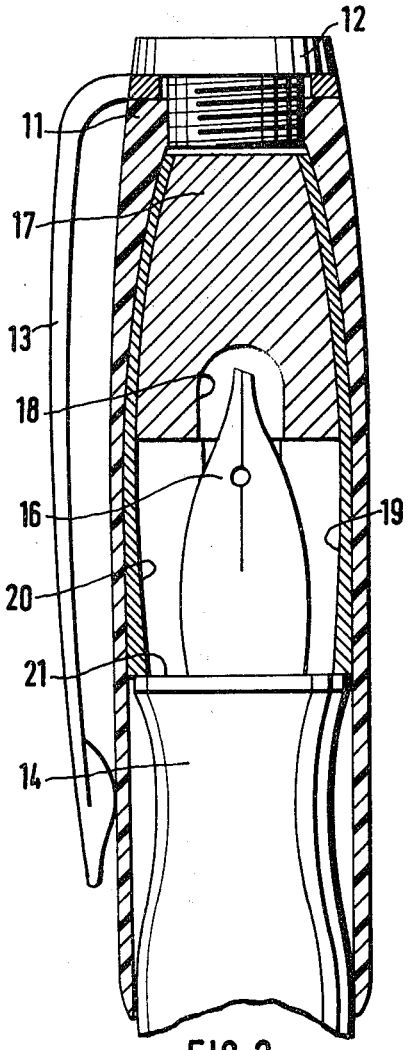
FIG. 2 is an axial section through the upper end of a fountain pen having a permanent-magnetically held closure cap according to a variation of the present invention placed on the pen.

The nib 16 of the fountain pen 14 shown in FIG. 2 is protected by a cap 11 which is similarly provided with a closure plug 12 and a clip 13. The permanent magnet 17 accommodated here in the cap 11, in contrast to the construction pursuant to FIG. 1, is magnetized in the transverse direction. In this manner essentially half cylindrical mantle-like pole faces result on the nearly cylindrical permanent magnet. These pole faces are covered by cup or shell-like pole shoes 19,20 which project toward the open end of the cap 11. If desired, in order to further strengthen the magnetic force operative as the holding force, a recess 18 extending between the two magnet poles may be worked or milled in on the end face of the magnet 17. This recess 18 makes it possible to bring the magnet 17 even closer to the writing nib 16. With this specific embodiment, when the cap 11 has been placed on the pen 14, the magnetic circuit is closed by a ferro-magnetic ring 21 which is flush mounted on the fountain pen 14 where the nib 16 emerges from the pen 14. The end faces of the pole shoes 19,20 engage this ferro-magnetic ring 21 in the axial direction. Tests have shown that the pole shoes 19,20 constructed as described above and attached to the permanent magnet, produce only relatively small dissipation in the magnetic circuit, so that also with this specific embodiment a great holding force is insured. By appropriate tests, the length of the pole shoes 19,20 and the depth of the recess 18 placed in the magnet 17 are so coordinated that the optimum magnet holding force is achieved. It is to be understood, of course, that the specific embodiment pursuant to FIG. 2 is also usable for other types of writing instruments.

Barium ferrite crystals, preferably embedded in synthetic material, for instance synthetic rubber, and axially parallelly aligned, serve as material for the permanent magnets. This material permits a particularly economical manufacture of the magnets, since it may be easily machined. In principle, however, other modern suitable permanent magnets are also usable. Ferritic chrome steel materials are suitable examples of soft magnetic material for the pole shoes and their contact surfaces, particularly with a view to avoiding corrosion. Tests have shown that the greatest holding forces result with pole shoes of small cross section of a material sold under the trade name Vanadium-Permendur and made and sold by Vakuum-Schmelze Hanau, West Germany. This material comprises approximately 49% cobalt, 2% vanadium and 49% iron. The soft magnetic materials are preferably subjected to a suitable heat treatment in a manner known per se to achieve maximum holding force.

Aside from the structural elements belonging to the magnetic holding circuit, the remaining parts of the writing instrument should preferably comprise non-magnetic material. Since, for the construction of writing instruments, plastics, brass, austenitic steels, or precious metals are used almost exclusively, the installation of magnetic parts is generally economically possible without structural or material related changes to the remainder of the writing instrument.

It is obvious for skilled personnel, if desired, to also provide holding parts on the back end of the writing instrument, which holding parts can work together with the permanent magnet of the cap to firmly hold the cap in the writing position on the back end of the writing instrument.

It is, of course, to be understood that the present invention is by no means limited to the specific showing in the drawings, but also encompasses any modifications within the scope of the appended claims.

What I claim is:

1. For use in connection with a writing instrument having ferro-magnetic means on at least a portion of the writing end of said writing instrument, a closure cap having a normally closed end and an open end and an inner contour capable of being placed over said writing end of said writing instrument, said cap comprising in combination:

a permanent magnet having pole faces and being located within said cap, and pole shoes located on at least a part of said pole faces of said permanent magnet, at least a portion of said pole shoes being engageable with said ferro-magnet means, said permanent magnet and said pole shoes together forming a permanent magnet system connected to said cap urged and held in completely seated closure positioning by mainly axially directed magnetic forces, said permanent magnet being magnetized in the longitudinal direction of said cap and having an axial bore corresponding in shape to the shape of said writing end of said writing instrument, said pole shoes comprising a first annular disc located on that pole face of said magnet directed towards said closed end of said cap and a second annular disc located on that pole face of said magnet directed towards said open end of said cap, said pole shoes extending radially with regard to said axial bore, said first annular disc having a contact surface for axially engaging said ferro-magnetic means, and said second annular disc having a contact surface for radially engaging said ferro-magnetic means.

2. A closure cap in combination according to claim 1, in which the permanent magnet system has an outer contour that conforms to the inner contour of said cap.

3. A closure cap in combination according to claim 1, in which the inner wall surface of said permanent magnet forming said axial bore defines a truncated cone.

4. A closure cap in combination according to claim 1, in which said pole shoes comprising two sections are spaced from each other and form a mirror image of each other while being mounted on said permanent magnet so as to be symmetrical to each other with regard to said cap, said pole shoe sections projecting from said permanent magnet towards said open end of said cap.

5. A closure cap in combination according to claim 4, in which said permanent magnet, on that end face thereof directed towards said open end of said cap, has a recess extending in the longitudinal direction of said cap.

6. A closure cap in combination according to claim 4, in which said pole shoe sections have a contact surface for axially engaging said ferro-magnetic means.

7. A closure cap in combination according to claim 1, in which said permanent magnet comprises barium ferrite crystals embedded in synthetic material.

8. A closure cap in combination according to claim 1, in which said pole shoes comprise a vanadium, cobalt, iron alloy.

9. A closure cap in combination according to claim 8, in which said alloy comprises about 2% vanadium, 49% cobalt, and 49% iron.

10. In combination: a writing instrument having a writing end and also having ferro-magnetic means on at least a portion of said writing end, and a closure cap with an open end and an oppositely located closed end, said cap extending and fitting over said writing end and including: a permanent magnetic having pole faces and being within said cap, pole shoes located on at least a part of said pole faces of said permanent magnet, at least a portion of said pole shoes engaging said ferro-magnetic means, said permanent magnet and said pole shoes together forming a permanent magnet system connected to said cap and with said ferro-magnetic means forming a closed magnetic circuit, said cap being urged and held in completely sealed closure positioning by mainly axially directed magnetic forces, said permanent magnet being magnetized in the longitudinal direction of said cap and having an axial bore corresponding in shape to the shape of said writing end of said writing instrument, said pole shoes comprising a first annular disc located on that pole face of said magnet directed towards said closed end of said cap and a second annular disc located on that pole face of said magnet directed towards said open end of said cap, said pole shoes extending radially with regard to said axial bore, said first annular disc having a contact surface for axially engaging said ferro-magnetic means, and said second annular disc having a contact surface for radially engaging said ferro-magnetic means.

* * * * *